US011084562B1

(12) United States Patent
Sanders

(10) Patent No.: US 11,084,562 B1
(45) Date of Patent: Aug. 10, 2021

(54) TRAVELER CONTROL

(71) Applicant: Henry Sanders, Hilton Head Island, SC (US)

(72) Inventor: Henry Sanders, Hilton Head Island, SC (US)

( * ) Notice: Subject to any disclaimer, the term of this patent is extended or adjusted under 35 U.S.C. 154(b) by 0 days.

(21) Appl. No.: 16/784,997

(22) Filed: Feb. 7, 2020

(51) Int. Cl.
*B63H 9/10* (2006.01)
*B63H 9/08* (2006.01)

(52) U.S. Cl.
CPC ..... *B63H 9/10* (2013.01); *B63H 2009/088* (2013.01)

(58) Field of Classification Search
CPC ... B63H 9/00; B63H 9/04; B63H 9/08; B63H 9/10; B63H 2009/088
USPC ..... 114/204, 205
See application file for complete search history.

(56) References Cited

U.S. PATENT DOCUMENTS 3,623,445 A * 11/1971 Holmes ..... B63H 9/10 114/204
3,678,876 A * 7/1972 Alter ..... B63H 9/10 114/102.19
3,985,092 A 10/1976 Robbins
4,080,919 A 3/1978 Holland et al.
4,147,121 A * 4/1979 Fogh ..... B63H 9/10 114/199
D255,322 S 6/1980 Ireland
4,319,537 A * 3/1982 Hackney ..... B63H 9/10 114/111
4,651,668 A 3/1987 Melrose
4,671,201 A 6/1987 Yokoyama
4,719,869 A 1/1988 Harken et al.
4,881,481 A 11/1989 Asmussen
5,249,544 A * 10/1993 Lacan ..... B63H 9/10 114/204
5,485,800 A * 1/1996 Lob ..... B63H 9/10 114/102.21
5,799,601 A * 9/1998 Peay ..... B63H 9/08 114/98
10,556,641 B1 * 2/2020 Halliburton ..... B63H 9/10

FOREIGN PATENT DOCUMENTS

EP 0541430 5/1993
WO WO2008036418 3/2008

* cited by examiner

*Primary Examiner* — Daniel V Venne
(74) *Attorney, Agent, or Firm* — B. Craig Killough; Hellman & Yates, PA

(57) ABSTRACT

A traveler control for a boat includes a car that traverses a track. A first sheave is positioned on a first end of the car and a second sheave is positioned on an opposite end of the car. A line is fixed at a first end and is routed through the first sheave. The line is routed through a plurality of turning blocks. An opposite end of the line is fixed after routing the line through the second sheave. The traveler control provides a mechanical advantage for convenient and precise positioning of a mainsail of a sailboat.

10 Claims, 5 Drawing Sheets

TRAVELER CONTROL

FIELD OF THE INVENTION

This invention relates to sailing and sailboats.

BACKGROUND OF THE INVENTION

A mainsheet traveler is a device that allows changing the position of the mainsail. The mainsheet traveler is positioned where the mainsheet tackle connects to the boat. The traveler is typically mounted either in the cockpit or on the cabin top for mid-boom sheeting. Mainsheet tackle connects the boom above to the boat below.

The traveler keeps the boom centered when sailing close-hauled. The mainsail is trimmed further off the wind by letting the sheet out, allowing the boom and sail to swing father to leeward. In certain situations, the mainsail may be trimmed by moving the traveler rather than letting out the mainsheet.

There is a need for a traveler control that is more convenient to use and is easier to precisely position when under sail with substantial wind pressure on the mainsail.

SUMMARY OF THE INVENTION

The present invention is traveler control for a boat. The traveler control includes a car that traverses a track. A first sheave is positioned on a first end of the car and a second sheave is positioned on an opposite end of the car. A line is fixed at a first end and is routed through the first sheave. The line is routed through a plurality of turning blocks. An opposite end of the line is fixed after routing the line through the second sheave.

Cleats and/or a braking winch secure the line in a desired position. Movement of the line moves the car laterally to position the car and mainsheet tackle, thereby positioning the boom of the sailboat.

BRIEF DRAWING DESCRIPTION

DESCRIPTION OF PREFERRED EMBODIMENTS

Figure 1:
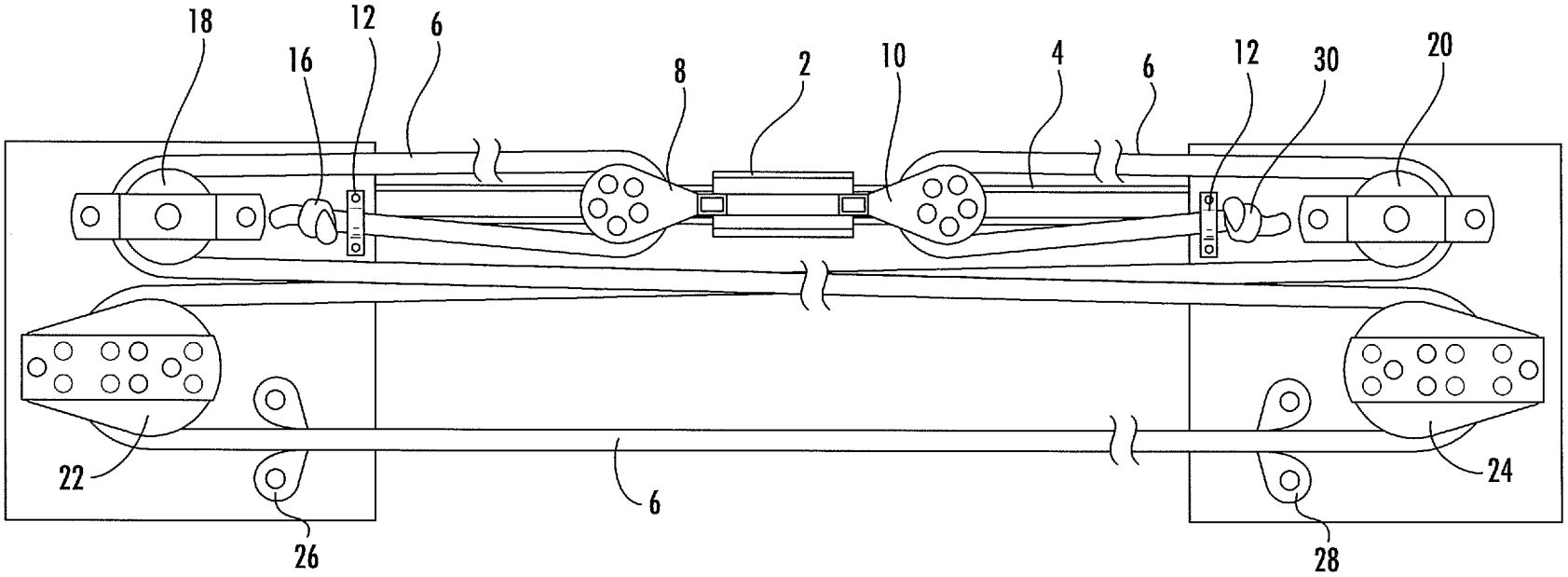
FIG. 1 is a top plan view of an embodiment of the traveler control.
Figure 2:
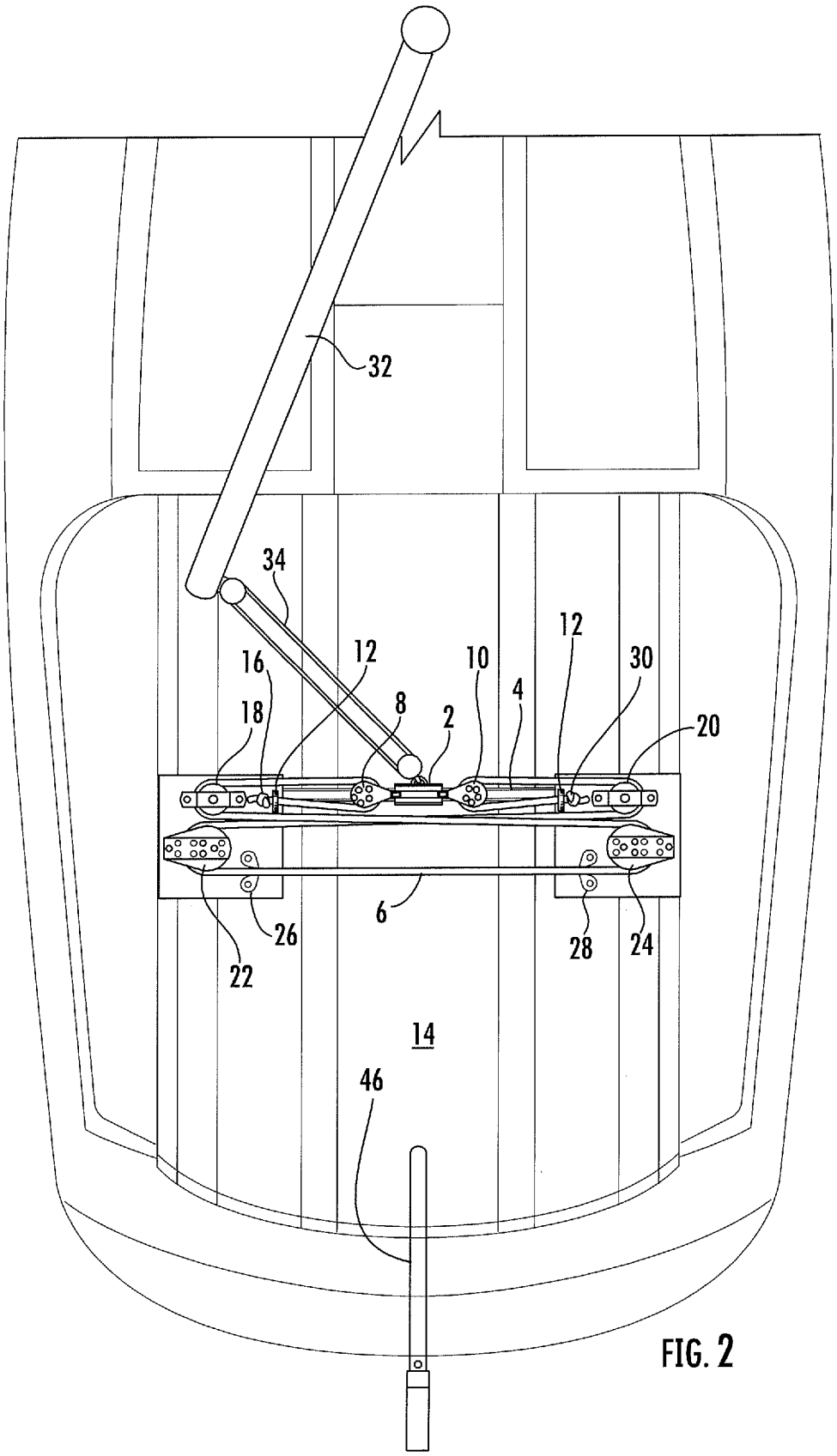
FIG. 2 shows the traveler control of FIG. 1 mounted in a cockpit of a sailboat.

The traveler control comprises a car 2. The car moves laterally along a track 4. The car is positioned by movement of line 6. In use, the car is attached to a mainsheet 34 as shown in FIG. 2. The mainsheet is attached to a boom 32 of the sailboat. In FIG. 1 the mainsheet and boom are not shown.

As shown in FIG. 1, a first sheave 8 is attached to one end of the car 2 and a second sheave 10 is attached to an opposite end of the car. The line 6 is fixed to the sailboat 14 at one end. The line may be fixed to the sailboat by a bracket 12 or other means, such as a cleat. The line may be fixed to the sailboat at any location that will accomplish the operation of the traveler control as described herein.

Beginning at the first terminal end 16 of the line 6, the line extends through the first sheave 8 as shown in FIG. 1. From there, the line continues through the first block 18 which turns the line about 180 degrees, but slightly more. The line then extends through the fourth block 24 where the line is again turned substantially 180 degrees. The line then extends through a cleat, which is preferred to be a cam cleat 28. The line then continues to opposite side of the sailboat where the line passes through an additional cleat, which, again, may be a cam cleat 26. The line continues through a third block 22 where it is turned somewhat more than 180 degrees and extends to an opposite side of the sailboat. The line crosses itself as shown in FIG. 1, travelling through a second block 20 where the line is turned somewhat more than 180 degrees. The line then extends through the second sheave 10 where the line is turned about 180 degrees. The line is then fixed or mounted as with the first end 16 of the line, such as by a bracket 12 or a cleat that holds the end of the line in place relative to the sailboat. The second terminal end 30 of the line is on an opposite side of the sailboat 14 from the first end.

The first block 18, the second block 20, the third block 22, and the fourth block 24 may be described as turning blocks, which turn the line 6 in each instance about 180 degrees. The line is preferred to be a single line, having a first end 16 and second end 30 as described.

Figure 4:
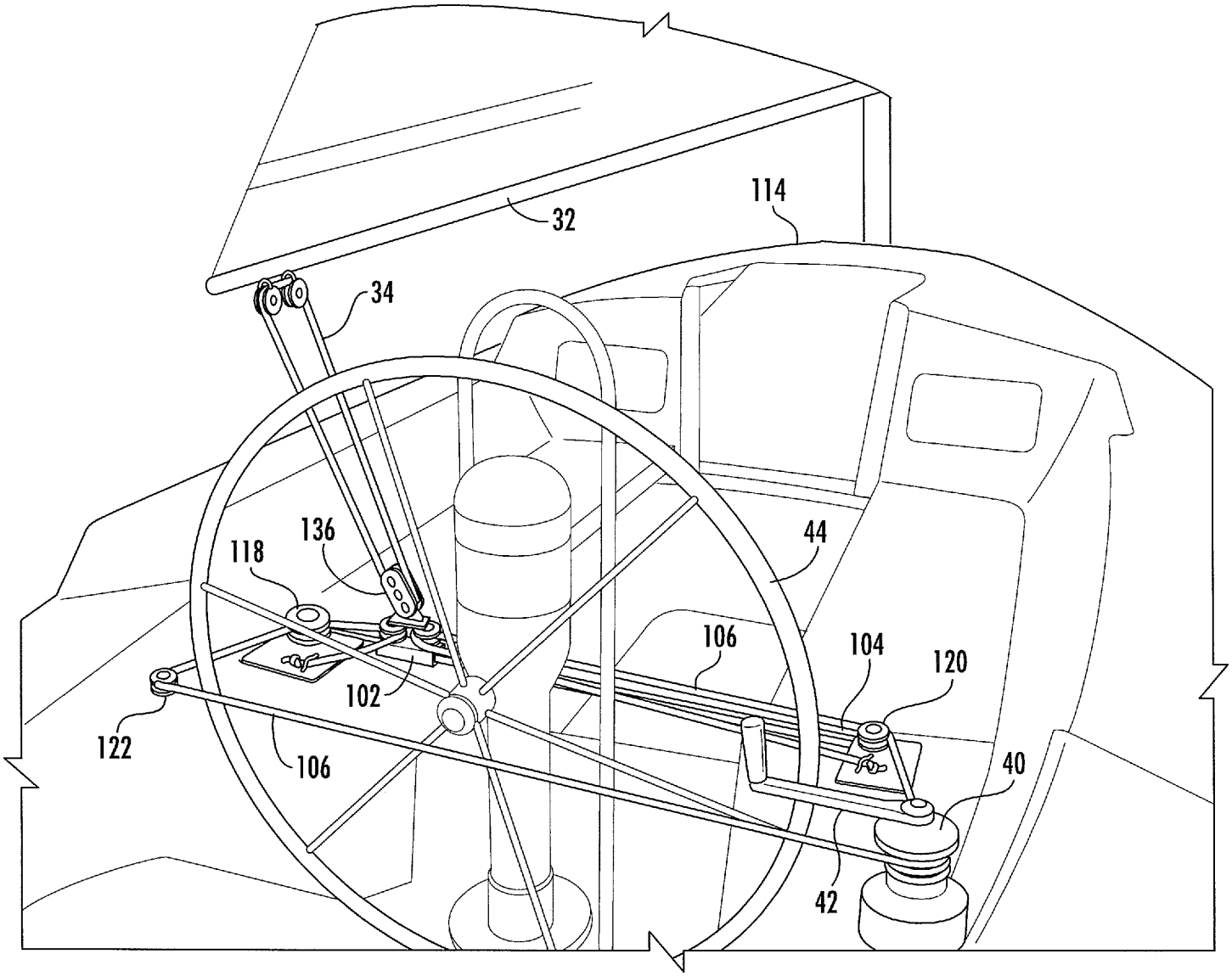
FIG. 4 is a top plan view of the traveler control of FIG. 3 in use with a sailboat.

Commonly, the traveler control is connected to the boom 32 above with a mainsheet 34. A fiddle block 36 may be used to connect the car 2 to the mainsheet as shown in FIG. 4. The fiddle block allows the length of the mainsheet to be adjusted. As shown in FIGS. 2 and 4, the traveler control is positioned in the cockpit of the sailboat 14. FIG. 4 demonstrates a larger sailboat having a ship's wheel 44. FIG. 2 demonstrates a sailboat that is tiller 46 controlled. The aft most portion of the line 6 positioned for control of the line by the helmsman so that the helmsman can conveniently adjust the traveler position. The traveler control could be mounted over the cabin of the sailboat, and while not convenient for the helmsman, this position is convenient to other crew members.

In use, movement of the car 2, and therefore the position of the boom 32, is accomplished by movement of the aft portion of the line 6. FIG. 2. A helmsman sailing single-handedly can move the aft portion of the line to the right or starboard, which moves the car to the right or starboard. Movement of the aft portion of the line to the left or port causes movement of the car to the left or port. In each case, movement of the car causes associated movement of the boom which is connected to the car by the mainsheet 34. The cam cleats 26,28 or other cleats hold the line in place thereby also holding the car and the boom in place in the position that is desired.

The control line 6 can be quickly released or unlocked from cam cleats 26,28, allowing rapid movement of the traveler. The device allows for quick and precise positioning of the boom and can be easily accomplished by the helmsman on most boats up to forty (40) feet without a winch due to the mechanical advantage provided by this embodiment of the invention.

Figure 3:
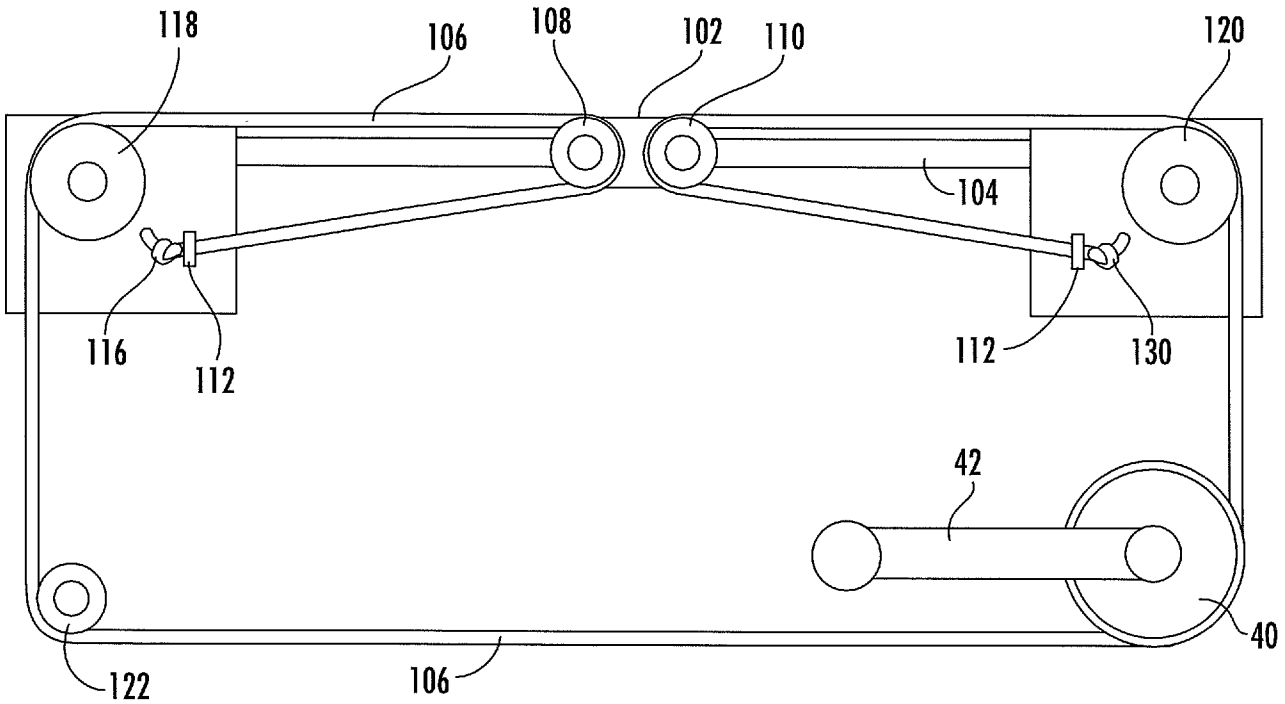
FIG. 3 is a top plan view of a traveler control that employs a winch.

For larger boats, such as sailboats over forty (40) feet in length, a winch 40 may be inserted into the line routing to provide additional power due to the higher wind pressure on the mainsail of larger boats with larger sails. The preferred winch is a two way winch, that is, a winch which will allow movement of the line in both directions. As shown in FIG. 3, clockwise movement of the winch will result in movement of the car to the right or starboard. Counterclockwise movement of the winch will cause movement of the car to the left, or to port.

The traveler control in this embodiment comprises a car 102. The car moves laterally along a track 104. The car is positioned by movement of line 106. In use, the car is attached to a mainsheet 34 as shown in FIG. 4. The mainsheet is attached to a boom 32 of the sailboat. In FIG. 3 the mainsheet car and boom are not shown Beginning at the first terminal end 116 of the line 106, the line extends through the first sheave 108 where it is turned more than 180 degrees as shown in FIG. 3. From there, the line continues through the first block 118. The line is turned to extends around the second block 122 where the line is again turned again toward the winch 40. The winch turns the line toward block 120. The line then extends around block 120 and is directed to the second sheave 110 where the line is turned more than 180 degrees. The line is then fixed or mounted (as with the first end 116 of the line 106), such as by a bracket 112 or a cleat that holds the end 130 of the line in place relative to the sailboat. The second terminal end 130 of the line is on an opposite side of the sailboat 114 from the first end.

The winch 40 is preferred to have a brake or locking mechanism so that the winch will not rotate unless the brake is released. The brake may be released by applying a force to the winch through the winch handle 42, such as by pushing down on the winch handle, so that a locking mechanism is released. The use of a winch having a brake obviates the need for cam cleats to hold the line 106 and car 102 in place after positioning.

Figure 6:
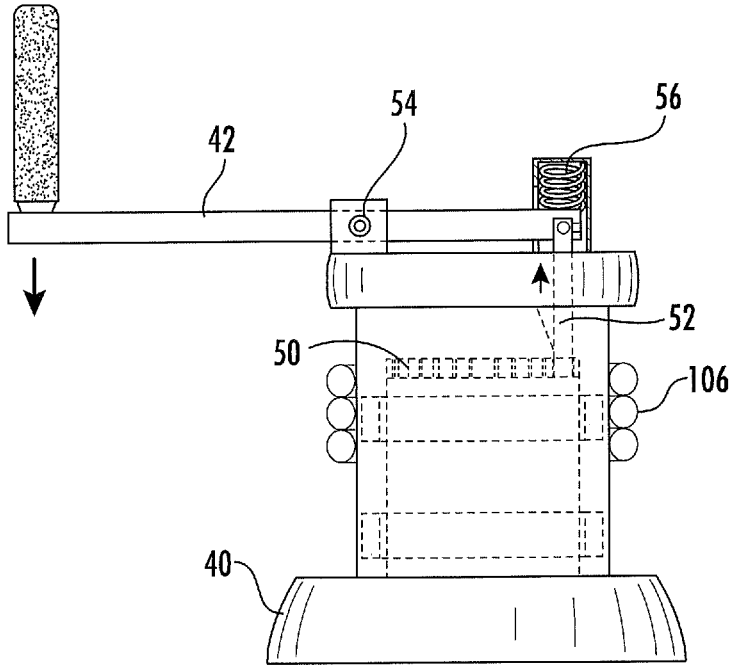
FIG. 6 is a sectioned view of the winch of FIG. 5
Figure 5:
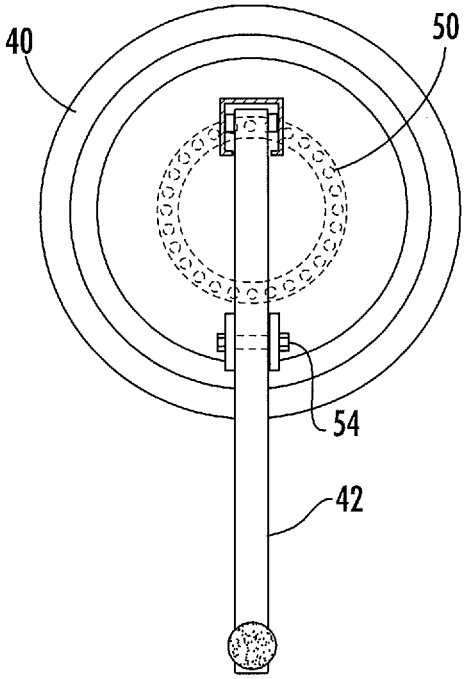
FIG. 5 is a top plan view of a winch as used in the traveler control of FIG. 3.
Figure 7:
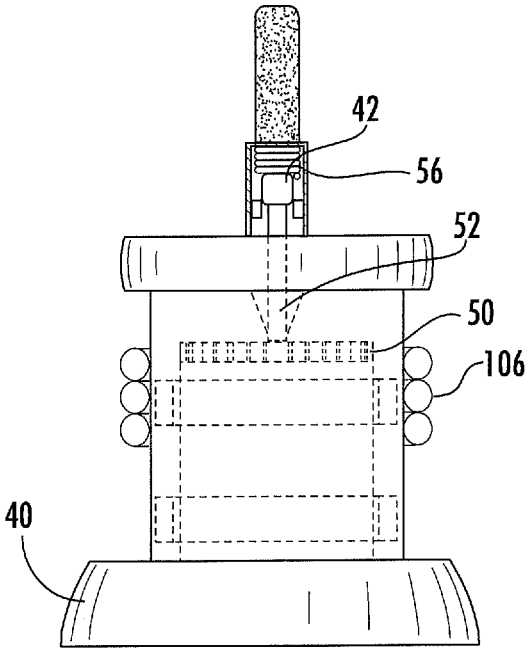
FIG. 7 is another sectioned view of the winch.

An example of a two way winch 40 that is useful with the invention is shown in FIG. 5, FIG. 6 and FIG. 7. A series of detents 50 is formed about a radius of the winch. A spring biased pin 52 is alternatively inserted into and removed from selected detents to hold the position of the winch as desired. The winch handle 42 pivots about pivot 54. Pushing down on the pivoting winch handle moves the pin upwardly and pulls the pin out of the detent, allowing the winch to be rotated clockwise or counterclockwise as desired by the crew of the sailboat. After rotating the winch to move the car 102 to a desired position, the winch handle is released and pivots in an opposite direction to place the pin in a detent, which locks or brakes the winch. Spring 56 holds the pin in the detent until downward pressure is applied to the winch handle to pivot the winch handle and remove the pin from the detent. The winch is thereby held in position, which also holds the traveler in the selected position.

What is claimed:

1. A traveler control for a boat, comprising:

a car, the car comprising a first sheave on a first end of the car and a second sheave on an opposite end of the car;

a first block that is laterally spaced apart from the first sheave and a second block that is laterally spaced apart from the second sheave, wherein the first block is positioned on an opposite side of the car from the second block;

a third block that is laterally spaced apart from a fourth block, wherein the third block is positioned on an opposite side of the car from the fourth block, and a line having a first terminal end, the line routed, beginning from the first terminal end, through the first sheave, subsequently through the first block, and then through the fourth block, and then through the third block, and then through the second block, and then though the second sheave, and the line subsequently terminating at a second terminal end.

2. A traveler control for a boat as described in claim 1, wherein each of the first block, the second block, the third block, and the fourth block is a turning block.

3. A traveler control for a boat as described in claim 1, further comprising a track, wherein the car is so constructed and arranged to traverse the track.

4. A traveler control for a boat as described in claim 1, further comprising a winch, wherein the line engages the winch.

5. A traveler control for a boat as described in claim 1, further comprising a winch, wherein the line engages the winch, and wherein the winch is a two way winch.

6. A traveler control for a boat as described in claim 1, wherein the first block turns the line about 180 degrees, then the fourth block turns the line about 180 degrees, and then the third block turns the line about 180 degrees, and then the second block turns the line about 180 degrees.

7. A traveler control for a boat as described in claim 1, wherein the first block, the second block, the third block and the fourth block are mounted to a sailboat and the first block and the third block are mounted to the sailboat on an opposite side of the sailboat from the second block and the fourth block.

8. A traveler control for a boat as described in claim 1, wherein the fourth block is a two way winch.

9. A traveler control for a boat as described in claim 1, further comprising a cleat positioned between the third block and the fourth block, and wherein the line is held in position by the cleat.

10. A traveler control for a boat as described in claim 1, further comprising a cam cleat positioned between the third block and the fourth block and wherein the line passes through the cam cleat.

* * * * *